US009688440B2

(12) United States Patent
Blonden et al.

(10) Patent No.: US 9,688,440 B2
(45) Date of Patent: Jun. 27, 2017

(54) SEALED CONTAINER

(75) Inventors: Sam John Blonden, London (GB); Chris Benning, Kent (GB)

(73) Assignee: ITW LIMITED, Berkshire (GB)

( * ) Notice: Subject to any disclaimer, the term of this patent is extended or adjusted under 35 U.S.C. 154(b) by 1416 days.

(21) Appl. No.: 13/057,199

(22) PCT Filed: Aug. 26, 2009

(86) PCT No.: PCT/IB2009/053743

§ 371 (c)(1),
(2), (4) Date: Feb. 2, 2011

(87) PCT Pub. No.: WO2010/029455

PCT Pub. Date: Mar. 18, 2010

(65) Prior Publication Data

US 2011/0142372 A1 Jun. 16, 2011

(30) Foreign Application Priority Data

Sep. 11, 2008 (GB) ..... 0816624.1

(51) Int. Cl.

| | |
|---|---|
| ***A44B 19/30*** | (2006.01) |
| ***A44B 19/24*** | (2006.01) |
| ***B65D 33/16*** | (2006.01) |
| ***B65D 33/34*** | (2006.01) |
| ***B65D 27/30*** | (2006.01) |
| ***B65D 33/25*** | (2006.01) |

(52) U.S. Cl.

CPC ..... *B65D 27/30* (2013.01); *A44B 19/30* (2013.01); *B65D 33/25* (2013.01); *B65D 33/34* (2013.01)

(58) Field of Classification Search

USPC ..... 383/5, 97–99; 150/134; 292/307 R, 292/317–321, 329

See application file for complete search history.

(56) References Cited

U.S. PATENT DOCUMENTS

| | | | | |
|---|---|---|---|---|
| 1,087,049 | A * | 2/1914 | Norris | 229/78.1 |
| 1,814,773 | A * | 7/1931 | Stillman | 292/307 R |
| 4,082,336 | A | 4/1978 | Natkins | |
| 4,106,801 | A | 8/1978 | De Lima Castro Neto | |

(Continued)

FOREIGN PATENT DOCUMENTS

| | | |
|---|---|---|
| EP | 0043726 A1 | 1/1982 |
| EP | 1701327 A2 | 9/2006 |

(Continued)

OTHER PUBLICATIONS

ISR fand Written Opinion for PCT/IB2009/053743.
British Search Report for GB0816624.1.

*Primary Examiner* — Nathan J Newhouse
*Assistant Examiner* — Nina Attel
(74) *Attorney, Agent, or Firm* — Hauptman Ham, LLP

(57) ABSTRACT

The application describes a container, bag, pouch or envelope which has a first part and a second part, the container, bag, pouch or envelope being closed by the first part locating within the second part, the second part having a first opening for receiving the first part and a second opening for receiving the head of a breakable and disposable seal which locks into the first part in such a manner that it cannot be removed without breaking the seal, the seal in its inserted position locking the first part in place inside the second part in a tamper evident fashion.

8 Claims, 3 Drawing Sheets

(56) References Cited

U.S. PATENT DOCUMENTS

| | | | | |
|---|---|---|---|---|
| 4,512,599 | A | 4/1985 | De Lima Castro Netto | |
| 4,995,656 | A * | 2/1991 | Akashi | 292/307 R |
| 6,533,335 | B2 * | 3/2003 | Hudson | 292/307 R |
| 7,370,892 | B2 * | 5/2008 | Collingham | 292/329 |

FOREIGN PATENT DOCUMENTS

| | | | |
|---|---|---|---|
| GB | 1424680 | | 2/1976 |
| GB | 2115354 | A | 9/1983 |
| WO | 2004/017280 | A1 | 2/2004 |

* cited by examiner

SEALED CONTAINER

RELATED APPLICATIONS

The present application is National Phase of International Application Number PCT/IB2009/053743, filed Aug. 26, 2009, and claims priority from, British Application Number 0816624.1, filed Sep. 11, 2008.

The invention relates to a closeable container for holding documents or other items of value, for example a bag, pouch or reusable envelope, which has an opening which can be closed. The container has a lock unit at the opening which cooperates with a disposable sealing member (a "seal") to close the container.

The invention is, for example, concerned with the type of container described in GB-A-1424680. In this reference, an envelope with a zipped opening is described. At one end of the zipped opening is mounted the lock unit, this lock unit having a raised housing or chamber with an opening on one side. The fastener tab of the zip has a central aperture so that it can fit over the chamber and then a disposable sealing element (known for simplicity as a "seal") is pushed into the chamber over the fastener tab to hold it in place and thus lock the zipped opening. The seal is a substantially flat element, moulded from a suitable plastics material, which has a head part and a body part. Between these two parts is a weakened or frangible section and it is the head part which locks into the chamber by means of the resilient barbs of its arrowhead configuration. The dimensions of the seal are such that the weakened or frangible section is at the mouth of the chamber. The seal cannot then be removed whole from the chamber and must be broken in order to release the fastener tab of the zip. The lock unit and disposable seal thus provide tamper evidence to the container. Problems remain with this type of container, in that it is not fully secure and there is the possibility of the connection between the seal and the lock unit being tampered with, so that the container is opened without breaking the seal, thus destroying the "tamper evidence". This is particularly the case because a space is provided at the bottom of the chamber to receive the broken head of seal.

For the avoidance of any doubt, while the invention is in part concerned with a zipped envelope of the type discussed above, the invention which is set out below is also applicable to other types of envelopes, pouches or containers where one part (lid, flap etc) can cooperate with another part (the main body of the container, for example) which has a lock unit.

The aim of the invention is to provide a new and improved combination of a locking member (seal) and a closeable container, such as a zipped pouch or envelope.

According to the invention, there is provided a container, bag, pouch or envelope which has a first part and a second part, the container, bag, pouch or envelope being closed by the first part locating within the second part, the second part having a first opening for receiving the first part and a second opening for receiving the head of a breakable and disposable seal which locks into the first part in such a manner that it cannot be removed without breaking the seal, the seal in its inserted position locking the first part in place inside the second part in a tamper evident fashion, wherein the second part includes a chamber which communicates between the first and second openings, and wherein said first part has a recess shaped to receive the head of the seal, the chamber defining a path for the head of the seal such that on breaking of the seal the head remains in the first part as it is removed from the second part out of the first opening.

The fact that the head of the seal is initially held in the first part as it is removed is convenient for the user as it is not loose within the second part, from where it may drop on the floor. Furthermore, the relatively close fitting of the head of the seal in the first part, with no need to provide a space for the broken seal head to fall out, means that security is stronger and there is less possibility of the closure being tampered with, for example by means of a pin inserted between the seal and the first part when inside the second part.

Preferably, the chamber is defined between the top of the second part and an internal floor thereof. The second part may include a seat for the said seal and the seat may extend into the second part to form the said floor.

In practice, a plurality of said seals will be provided in order that the container, bag, pouch or envelope can be re-used with a fresh seal.

The one part may be inserted transversely to the insertion direction of the first part into the second part, or it can be inserted opposite to that insertion direction. In other words, the recess of the first part can either be at the side or the front, relative to the insertion direction.

Typically, the said first part is the fastener tab of the zipped opening of a reusable pouch or envelope and the second part is a lock unit mounted on the pouch or envelope, adjacent one end of the zipped opening. Alternatively, the first part can be a catch on the flap or lid of a pouch, envelope or container which fits in a lock unit on the main body of the pouch, envelope or container, the catch being provided with the recess.

Preferred embodiments of the invention are described in more detail below, with reference to the accompanying figures, wherein.

Figure 1:
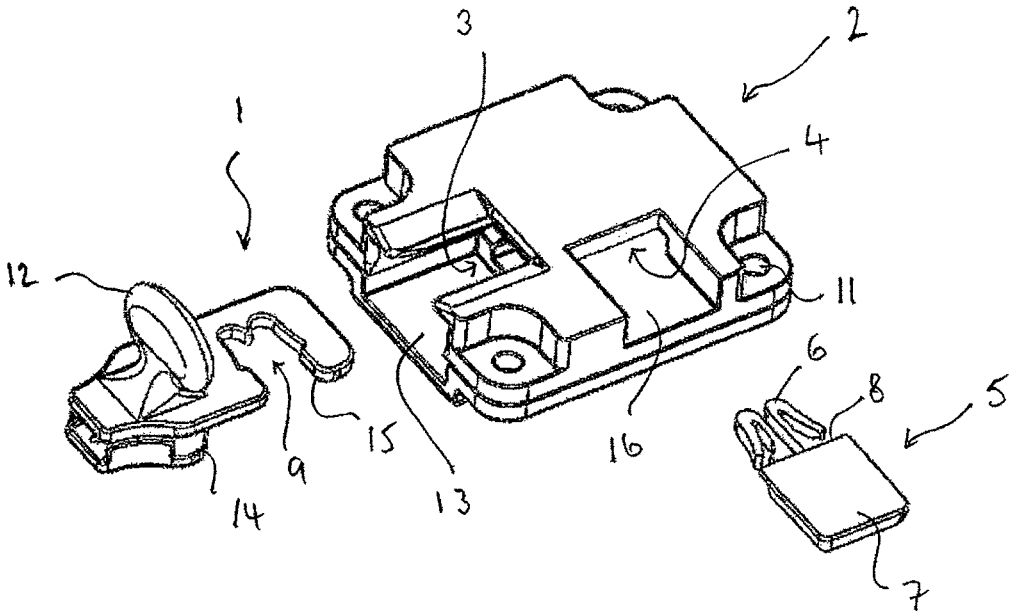
FIG. 1 is a perspective view the lock unit and fastener tab for a zipped reusable envelope or pouch for use, with a locking member or seal, according to one embodiment of the invention, the envelope not being shown.

In FIG. 1 is shown a combination of a breakable and disposable seal and part of a container, bag, pouch or envelope which is closed by one part 1 locating within a second part 2, the second part 2 having a first opening 3 for the one part and a second opening 4 for receiving part of the breakable seal 5 which locks into the one part in such a manner that it cannot be removed without breaking.

The seal 5 in its inserted position locks the first part 1 in place inside the second part 2 in a tamper evident fashion. The seal 5 comprises a head part 6 and a body part 7, the head part in use locating in the one part through the second opening 4 of the said second part.

The invention provides that said one part has a recess 9 shaped to receive the head of the seal, the lock unit being formed such that on breaking of the seal the head remains in the one part 1 as it is removed from the second part 2. If the head of the seal 5 is arrow-head shaped, then the recess 9 has a complementary shape, with a narrowed mouth.

Figure 2:
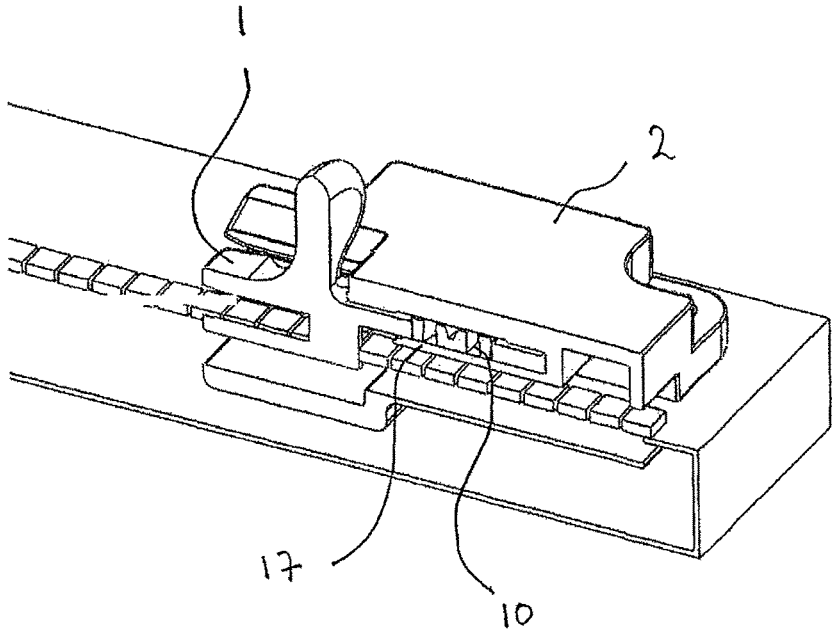
FIG. 2 is a partially cut-away perspective view of the lock unit and fastener tab of FIG. 1, mounted at the end of a zip along the top of a pouch.

In FIG. 1 the first part 1 is the fastener tab of the zipped opening of a pouch or envelope and the second part 2 is a lock unit on the pouch or envelope, at the end of the zipped opening of the pouch or envelope. The lock unit 2 may be substantially square and be moulded in two parts. The lock unit is partly hollow so as to define an interior space or chamber 10 for receiving the fastener tab 1, as seen more clearly in FIG. 2 (FIG. 2 shows the tab and seal present in the chamber 10). The chamber 10 communicates between the openings 3 and 4 and thus provides a double-ended passageway for receiving the tab 1 and the seal 5 at opposite ends, and for allowing the head of the seal to be removed along with the tab 1.

The two moulded parts of the lock unit may be riveted together by means of corner holes 11, and also riveted either side of the fabric of the envelope at the end of the zipped opening, as shown more clearly in FIG. 2. The chamber 10 is formed in the upper moulded part, on the outside of the envelope.

FIGS. 1 and 2 show that the first opening 3 of the lock unit 2 faces the sliding direction of the zip, so that it receives the fastener tab 1 when the zipped opening is closed. The tab 1 has an upstanding lug 12 to aid its movement by the user, but this is not essential to the invention.

The recess 9 is at the side of the tab 1, relative to the sliding and insertion direction of the tab. When the tab 1 is received in the lock unit 2, the recess 9 registers with the opening 4 of the lock unit which is at the side of the lock unit.

FIG. 1 also shows the disposable and frangible seal 5. The seal 5 is substantially flat and includes the head part 6 and body part 7. The head part has an arrowhead configuration with resilient barbs 10, in a known fashion. Between the body part 7 and the head part 6 is a line of weakness 8 formed, for example, by an elongate recess (not seen) in a conventional fashion, this line providing for the breakable connection between the head and body parts. The main part 7 in this embodiment is substantially square (it could be of any other desired shape). The overall dimensions of the seal are typically about 22 mm long by 11 mm wide by 2.5 mm thick. The thickness of the head is typically 2.0-2.5 mm; in practice the seal head is the same thickness as the body or slightly thinner.

To close the pouch or envelope the fastener tab 1 is pulled to close the zipped opening and is located in the lock unit 2. The opening 3 provides a seat 13 for the tab 1, which seat is deeper than the forward part of the tab 1 having the recess 9, so that it accommodates a thickened portion 14 of the tab. The ends of the seat 13 and portion 14 thus define a stop position for the tab 1 in the lock unit.

To finally lock the envelope in a tamper evident fashion, the seal 5 is pushed into the lock unit 2, the head part 6 of the seal locating within the lock unit 2 and within the recess 9 of the tab 1. In particular the resilient barbs 10 are squeezed through the narrowed mouth of the recess 9 to locate behind the shoulders 15 of the recess 9, which as already explained is shaped correspondingly to the head of the seal, so that the seal cannot be removed without breaking the body part 7 from the head part 6.

As most clearly seen in FIG. 2, the opening 4 in the lock unit communicates with the chamber 10 within the lock unit, which receives the head of the seal as described above. The chamber is defined by a floor 17 and the top of the lock unit, the height of the chamber being only slightly greater than the thickness of the head of the seal.

The opening 4 of the lock unit also defines a seat 16 for the body 7 of the seal, so that the seal is inserted within the lock unit, but with the body 7 exposed. The seat 16 extends within the lock unit to form the floor 17. In other words, there is no space beneath the seal in its insertion position. It will also be understood that the height of the opening 4 is only very slightly greater than the thickness of the head of the seal.

As explained above, the chamber 10 of the lock unit also communicates with the opening 3 which receives the tab 1. As seen in FIG. 2, the floor 17 does not extend fully to the mouth of opening 3, as space must be provided for flexing of the zip as it is opened and closed.

The outer end of the seal 5 extends slightly beyond the edge of the lock unit, so that it can be lifted (i.e. the length of the seal body 7 is slightly greater than the length of the seat 16). In the locked position of the tab, seal and lock unit, it is obvious that the tab 1 cannot be pulled out of the lock unit 2, as the laterally inserted seal is blocked against the sides of the seat 16 of the lock unit.

To open the pouch or envelope, the user's finger is placed below the outer end of the seal 5 and the body 7 is lifted. This causes the seal to be broken along the line of weakness 8 so that the body 7 is no longer retaining the tab 1. The head 6 of the seal is, however, retained in the tab 1 because it is supported by the floor 17. This arrangement contrasts with prior art containers where on breaking of the seal the head falls to the bottom of the lock unit and is shaken from the lock unit before the container is re-used.

The support of the seal head by the floor 17 determines that as the zipper tab is pulled out of the lock unit, the seal head must stay within the tab. At the end of the floor 17, the seal head is still held by the tab as there is insufficient space for it to drop out; in other words even at this position the seal head is partly supported by the end of the zip in the lock unit. After the tab is fully removed from the lock unit, to allow the zipped aperture of the envelope to be opened, the head of the seal can drop into the user's hand (or be pushed out of the tab by hand) and neatly disposed of. The fact that the head is initially retained in the tab is convenient for the user as it is not loose within the lock unit, from where it may drop on the floor.

Furthermore, the close fitting of the head of the seal in the fastener tab, because the seat 16 defines the bottom of the opening 4, means that security is stronger and there is less possibility of the closure being tampered with, for example by means of a pin inserted through the opening 4 between the seal 5 and the fastener tab 1 when the tab is inside the lock unit.

Still further, the fact that the head of the seal is pulled out with the tab means that the lock unit can routinely be made of opaque material. This is advantageous because in the prior art, there was a desire to make transparent lock units, so that the user can see if a broken seal head is caught in the lock unit, but making the lock unit transparent decreased security and tamper resistance because the cooperation between a pin (used for unauthorised tampering) and the barbs of the seal could be observed.

Figure 3:
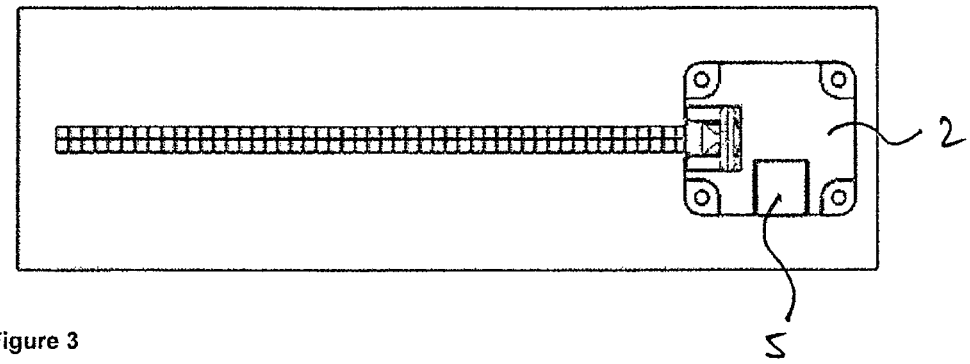
FIG. 3 is a top view of the pouch of FIG. 2.

Incidentally, although FIGS. 2 and 3 for simplicity show the pouch as a rectangular box-like structure, in practice the container would be formed of a flexible fabric so that a precise rectangular shape would normally not exist in practice. It will be understood that the pouch of FIGS. 2 and 3 has a bottom and top of a significant width, so that a larger amount of paper or other items of value can be fitted inside, as compared with a flat envelope or pouch.

In an alternative embodiment, the recess 9 could be at the end of the tab 1 and the opening 4 could be in the end of the lock unit, so the seal 5 is inserted in the opposite direction to the tab 1. This would require the body of the seal to be wider than the opening 4.

The lock unit and fastener tab may be formed of a suitable material, such as hardened steel, or of plastics such as nylon, polypropylene, ABS, styrene or engineering plastics. The disposable seals, which will generally be supplied in bulk, are formed of a suitable resilient but frangible plastics material, such as styrene, ABS, nylon or polypropylene.

Figure 4:
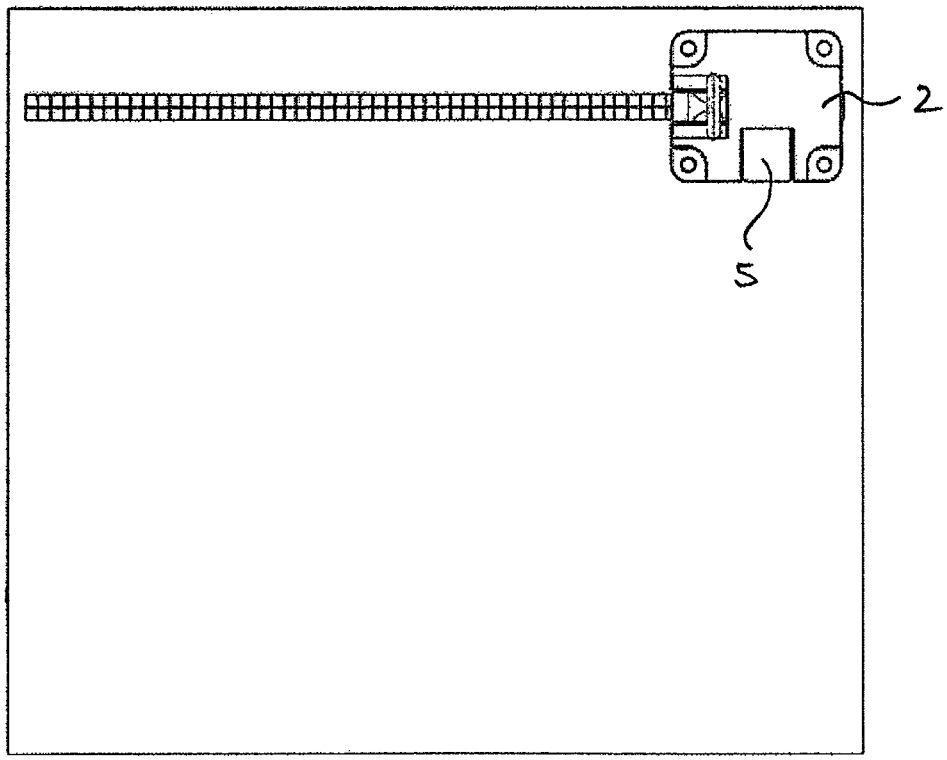
FIG. 4 is a front view a flat zipped envelope with a lock unit mounted at the end of a zip along the top of the envelope front.
Figure 5A:
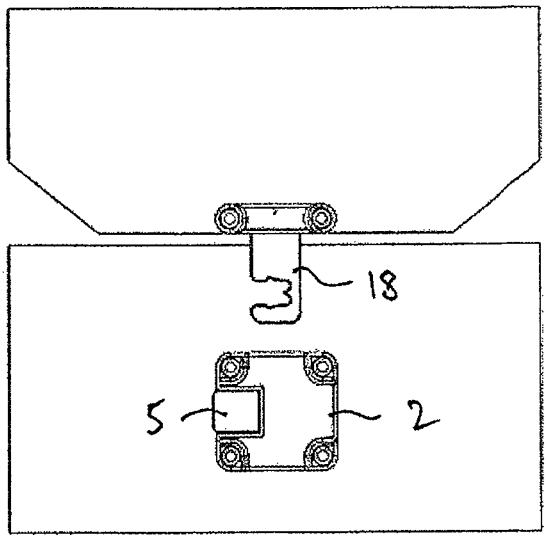
FIGS. 5*a* and 5*b* are plan views of an alternative embodiment, where the envelope has a flap.
Figure 5B:
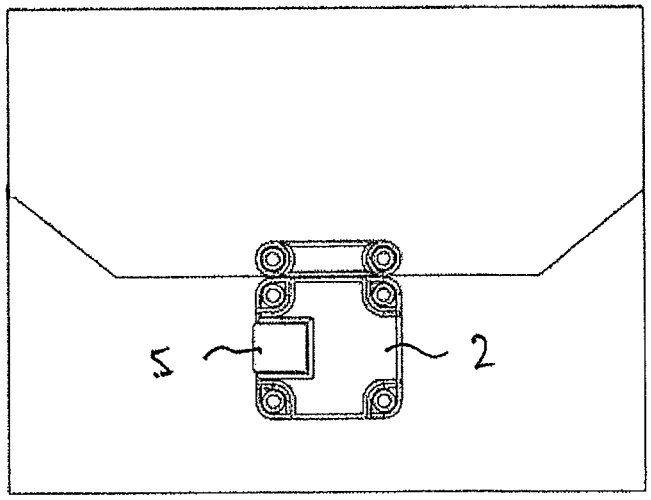

Although the invention has been described with reference to a zipped pouch envelope it is equally relevant to other types of containers. For example, the container (for example a pouch or envelope) could be substantially flat with a zip along the top of its front, as seen in FIG. 4. Alternatively, the container (for example a pouch or envelope) could have a flap with a tongue or catch which registers with a lock unit on the main part of the container, the catch having the above-described recess and the seal then going into the lock unit to secure the flap in place. This arrangement is shown in FIGS. 5*a* and 5*b*, it being understood that the catch 18 of the flap is functionally equivalent to the fastener tab 1 of FIGS. 1 and 2, so that further detailed description is unnecessary.

The invention claimed is:

1. A container, comprising a first part, a second part, and a breakable and disposable seal having a head, the second part having a first opening and a second opening, the first opening for receiving the first part, the container being closed by the first part locating within the opening of the second part, the second opening for receiving the head of the breakable and disposable seal, the head locking the first part within the second part when the first part and head are inserted in the second part, wherein the first part is not removable from the second part without breaking the seal, wherein the second part includes a chamber which communicates between the first and second openings, wherein said first part has an open recess shaped to receive the head of the seal, the chamber defining a path for the head of the seal such that on breaking of the seal the head remains in the first part as the first part is removed from the second part out of the first opening, the open recess allowing removal of the head from the first part, and wherein the first opening defines a first seat, and the second opening defines a second seat, wherein the first seat and second seat are offset such that the first seat is positioned at an elevation between the second seat and a surface of the container.

2. A container according to claim 1, wherein the chamber is defined between a top of the second part and an internal floor thereof.

3. A container according to claim 1, wherein the seal is inserted transversely to the insertion direction of the first part in the second part.

4. A container according to claim 1, wherein the seal is inserted opposite to the insertion direction of the first part in the second part.

5. A container according to claim 1, wherein a plurality of said seals are provided, and the container is reusable with a fresh seal.

6. A container according to claim 1, wherein the container is a zipped pouch or envelope and the first part is on the tab of the zip.

7. A container according to claim 1, wherein the container is a pouch or envelope with a flap and the first part is a catch on the flap.

8. A container according to claim 1, wherein the seal is inserted fully within the second opening.

* * * * *